US007316608B2

(12) United States Patent
Moody

(10) Patent No.: US 7,316,608 B2
(45) Date of Patent: Jan. 8, 2008

(54) VIDEO POKER GAMES WITH EXTRA HANDS ON NEXT ROUND FOR CERTAIN STARTING HANDS

(76) Inventor: Ernest W. Moody, 2116 Redbird Dr., Las Vegas, NV (US) 89134

( * ) Notice: Subject to any disclaimer, the term of this patent is extended or adjusted under 35 U.S.C. 154(b) by 521 days.

(21) Appl. No.: 10/645,358

(22) Filed: Aug. 21, 2003

(65) Prior Publication Data

US 2004/0116171 A1 Jun. 17, 2004

Related U.S. Application Data

(60) Provisional application No. 60/319,483, filed on Aug. 21, 2002.

(51) Int. Cl.
*A63F 9/24* (2006.01)

(52) U.S. Cl. ..... 463/16; 463/13

(58) Field of Classification Search ..... 463/13, 463/16, 12, 25, 20; 273/292
See application file for complete search history.

(56) References Cited

U.S. PATENT DOCUMENTS 5,823,873 A 10/1998 Moody ..... 463/13
6,050,568 A 4/2000 Hachquet ..... 273/292
6,135,883 A 10/2000 Hachquet ..... 463/13
6,419,578 B1 * 7/2002 Moody et al. ..... 463/13
6,474,645 B2 * 11/2002 Tarantino ..... 273/274
6,517,074 B1 * 2/2003 Moody et al. ..... 273/292
6,612,927 B1 * 9/2003 Slomiany et al. ..... 463/16
6,729,959 B1 * 5/2004 Moore et al. ..... 463/30
6,874,784 B1 * 4/2005 Promutico et al. ..... 273/292
2005/0187002 A1 * 8/2005 Falciglia, Sr. ..... 463/13

* cited by examiner

*Primary Examiner*—Robert E Pezzuto
(74) *Attorney, Agent, or Firm*—John Edward Roethel

(57) ABSTRACT

The game begins with a player playing a conventional hand of video poker. Whenever the player achieves one of the predetermined types of starting hand combinations on the original round of play of the hand of video poker, then the player is awarded one or more additional hands of video poker on the next round of play. The additional hands of video poker on the next round of play are played according to the multiple hand poker method described in U.S. Pat. No. 5,823,873; or U.S. Pat. No. 6,517,074; or U.S. Pat. No. 6,050,568 or U.S. Pat. No. 6,135,883. The award of one or more additional hands may continue consecutively as long as the player continues to achieve one of the predetermined types of winning hand combinations on the previous round of play of video poker.

7 Claims, 2 Drawing Sheets

VIDEO POKER GAMES WITH EXTRA HANDS ON NEXT ROUND FOR CERTAIN STARTING HANDS

CROSS-REFERENCE TO RELATED APPLICATION

This application is based on and claims the benefit of U.S. Provisional Application Ser. No. 60/319483, filed Aug. 21, 2002, entitled "Video Poker Games."

This invention relates primarily to video poker games, and more particularly to video poker games that are programmed to play on an electronic video poker machine. Based on achieving certain starting hand combinations, the player receives one or more extra hands on his next round of play. This process can continue to allow the extra hands to create additional extra hands.

For example, if the player receives a Three-of-a-Kind or better as a starting hand on a round of play, the player would earn a free extra hand on the next round of play. The player would make a wager to play the next round of video poker and both hands would be played as if they were carrying the same amount of wager, even though only one wager is made. In effect, the player is playing the additional hand for no extra cost.

The player would have to make a bet on the first hand in the next round to receive the extra hand bonus. If the player then made two Three-of-a-Kinds or better on the next round he would receive two extra hands on the following round and would play a total of three hands all for the cost of a single wager.

BACKGROUND OF THE INVENTION

Video poker that is played on an electronic video poker gaming machine is designed to replicate the play of a hand of poker. Typically, the player is not playing against any other player's hands or against a dealer's hand; the player is simply attempting to achieve the highest ranking poker hand possible from the cards displayed to the player. The higher the ranking of the poker hand achieved by the player, the greater the player's winnings based on the number of coins, tokens or credits wagered by the player. Typically, a payout schedule is posted on the gaming machine to advise the player of the payoffs available for certain winning card combinations.

The forerunner of all electronic video poker gaming machines is the video Draw Poker machine that deals cards from a standard fifty-two card poker deck and displays a single five card hand to the player. The player then selects which of the five cards he wishes to hold (or discard depending on the format of the gaming machine). The draw poker machine then displays replacement cards for the cards the player has discarded. The player wins or loses based on conventional poker hand rankings for the resulting five card hand.

In video Draw Poker, the conventional poker hand rankings that are winning combinations are a Royal Flush, a Straight Flush, a Four of a Kind, a Full House, a Flush, a Straight, a Three of a Kind, a Two Pair and a Pair of Jacks or Better. A payout table is established based on the number of coins wagered by the player and the type of poker hand achieved.

The classic draw poker machine has been modified to use Jokers as wild cards or to use Deuces (or even other cards) as wild cards. "Jokers Wild" and "Deuces Wild" draw poker still display to the player a single five card hand and allow the player to discard unwanted cards and receive replacement cards. The payout table is modified to recognize the differing odds for achieving various poker hands when wild cards are involved. Furthermore, different poker hand rankings are used in the pay table to recognize different winning combinations that can be achieved using wild cards.

There are many poker formats used in video draw poker. These poker game formats include Jacks (or even Tens) or Better Draw Poker, Bonus Poker, Double Bonus Poker, Double Double Bonus Poker, Super Double Bonus Poker, Triple Bonus Poker, Deuces Wild Poker, Jokers Wild Poker, Deuces and Jokers Wild Poker, etc. Many electronic video poker gaming machines are provided with a menu so that the player can indicate his choice of the poker game format that the player wishes to play and the player then makes his wager based on upon that choice of poker game format. Each poker format has its own pay table associated therewith.

U.S. Pat. No. 5,823,873 (Moody) (the disclosure of which is incorporated herein by this reference) describes an electronic video gaming machine and method in which the player may play multiple hands at the same time. The player makes a wager for each separate hand to be played by the player. One hand of five cards is dealt all face up. The player selects none, one or more of the face up cards from the first hand as cards to be held. The cards that are held are reused from the first hand into all of the other hands. Replacement cards for the non-selected cards are dealt into the first hand and additional cards are then dealt to the first hand, if needed, so that the first hand has five cards. Additional cards are also dealt to all of the other hands so that each hand is a five card hand. The poker hand ranking of each five card hand is determined row by row. The player is then paid for any winning poker hands based on a pay table and the amount of the player's wager. The most successful commercial embodiment of this multiple hand method of play is a three hand game known as TRIPLE PLAY DRAW POKER®, although there as also five hand, ten hand, fifty hand and even one hundred hand versions of this multiple hand game.

U.S. Pat. No. 6,517,074 (Moody et al.) (the disclosure of which is incorporated herein by this reference) describes another electronic video gaming machine and method in which the player may play multiple hands at the same time. The player makes a wager for each separate hand to be played by the player. A first hand of five cards is dealt all face up. The player selects none, one or more of the face up cards from the first hand as cards to be held. Replacement cards for the non-selected cards are dealt into the first hand and the player receives an award for any winning hand combinations.

The original five cards are redisplayed into a second hand. The player selects none, one or more of the face up cards from the second hand as cards to be held. Replacement cards for the non-selected cards are dealt into the second hand and the player receives an award for any winning hand combinations. This redisplay of the original hand, discarding and replacement continues until all of the number of hands selected to be played by the player are completed.

U.S. Pat. No. 6,050,568 (Hachquet) (the disclosure of which is incorporated herein by this reference) and U.S. Pat. No. 6,135,883 (Hachquet) (the disclosure of which is incorporated herein by this reference) each describes yet another electronic video gaming machine and method in which the player may play multiple hands at the same time. The player makes a wager for each separate hand to be played by the player, for example two hands. Two hands of five cards are dealt all face up, with each hand having the identical cards by suit and rank. The player selects none, one or more of the face up cards from the first hand as cards to be held and the player selects none, one or more of the face up cards from the second hand as cards to be held. The cards selected to be held from each hand may or may not be the same cards. Replacement cards for the non-selected cards are dealt into the first hand and replacement cards for the non-selected cards are dealt into the second hand and the player receives an award for any winning hand combinations in either or both of the first and second hands.

It is an object of the present invention to provide a new form of an electronic video poker game that provides the player with one or more additional video poker hands on the next round of play whenever the player achieves a certain starting hand combination on the original round of play.

It is a feature of the present invention that whenever the player achieves one of the predetermined types of starting hand combinations on the original round of play of video poker, then the player is awarded one or more additional hands of video poker on the next round of play. The additional hands of video poker on the next round of play are played according to the multiple hand poker method described in U.S. Pat No. 5,823,873; or U.S. Pat. No. 6,517,074; or U.S. Pat. No. 6,050,568 or U.S. Pat. No. 6,135,883. These one or more additional hands can be awarded with or without the player having to make an additional wager.

It is a further feature of the present invention that the award of one or more additional hands may continue consecutively as long as the player continues to achieve one of the predetermined types of starting hand combinations on the previous round of play of video poker.

It is an advantage of the present invention that the player is provided with one or more additional hands of video poker to play with having to make only one additional wager. This increases the player's opportunity to achieve winning payouts without significantly increasing the monetary risk to the player.

Other objects, features and advantages of the present invention will become apparent from a consideration of the following detailed description.

SUMMARY OF THE INVENTION

The method of the present invention begins with the player playing a conventional hand of video poker. Whenever the player achieves one of the predetermined types of starting hand combinations on the original round of play of the hand of video poker, then the player is awarded one or more additional hands of video poker on the next round of play. The additional hands of video poker on the next round of play are played according to the multiple hand poker method described in U.S. Pat. No. 5,823,873; or U.S. Pat. No. 6,517,074; or U.S. Pat. No. 6,050,568 or U.S. Pat. No. 6,135,883.

These one or more additional hands can be awarded with the player having to make only a single additional wager. The award of one or more additional hands may continue consecutively as long as the player continues to achieve one of the predetermined types of winning hand combinations on the previous round of play of video poker.

DETAILED DESCRIPTION OF THE PREFERRED EMBODIMENTS

Figure 1:
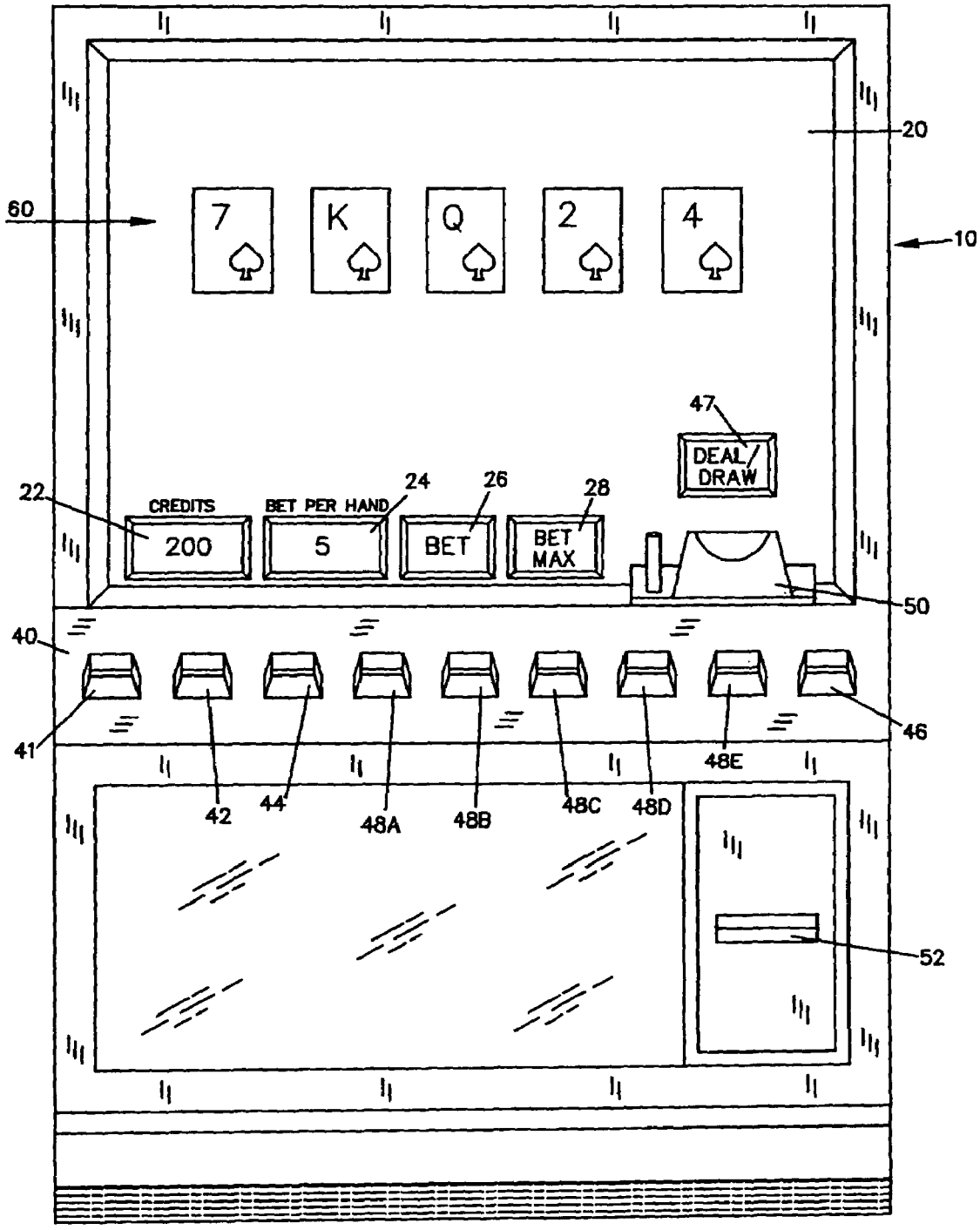
FIG. 1 shows a representative electronic video gaming machine of the present invention including a typical screen display used in the method of play of the present invention after the initial deal of the cards.

The method of the present invention can be applied to any poker format used for video poker. FIG. 1 shows generally at 10 a typical electronic video gaming machine that is configured to provide to the player the method of the present invention. The electronic video gaming machine 10 includes a conventional coin head 50 into which the player can insert coins or gaming tokens and a slot 52 which leads to a conventional bill acceptor mounted on the interior of the gaming machine and into which the player can insert paper currency. The use of coins, tokens or paper currency is the mechanism by which the player wagers on the poker hands the player wishes to play. As is also conventional in electronic video gaming machines, a credit meter display 22 is provided to show the amount of credits that the player has accrued on the gaming machine 10—either by inserting coins, tokens or paper currency or from winning plays achieved by the player. Whenever the player makes a wager, the amount of the wager is decremented from the credit meter display 22. Whenever the player achieves a winning play during the play of the game, the amount of the winning play is incremented on the credit meter display 22.

A conventional payout hopper is also located on the interior of the gaming machine and is used to dispense coins or tokens to the player into a payout tray 56 when the player wishes to collect any winning amounts the player has accrued. Other suitable and conventional payout mechanisms can be used, such as a ticket printer or other cashless payout devices.

The gaming machine 10 also includes a video screen display 20 of any suitable type upon which representations of playing cards are displayed. In a preferred embodiment of the present invention, one or more hands can be displayed on the video screen display 20 at the same time. As shown in FIG. 1, a first hand: HAND ONE 60 is shown. Each hand would preferably have five card locations preferably from left to right in a horizontal row, although other manners of displaying multiple hands can be used. The video screen display 20 also contains a location at which the amount wagered on each hand is shown, for example, "Bet Per Hand" 24.

A button panel 40 is also provided on the gaming machine 10 and the buttons mounted on the button panel 40 are used by the player to control the operation of the gaming machine 10. Any suitable configuration of the buttons on the button panel can be used and, alternatively, conventional touch screen technology can be used for any or all of the buttons mounted on the button panel.

A typical button arrangement is shown on the button panel 30 in FIG. 1. A "BET" button 42 is provided to allow the player to wager one credit at a time. A "BET MAX" button 44 is provided to allow the player to wager the maximum amount of credits permitted by the configuration of the gaming machine 10. Any number of credits can be set as the maximum amount that it is possible to wager on each hand and, typically, five credits will be the maximum number of credits for any particular hand. Alternatively, a BET location 26 and a BET MAX location 28 can be provided on the video screen 20 to allow the player to wager by using conventional touch screen technology.

A conventional "DEAL/DRAW" button 46 is also provided on the button panel 40 which is used by the player to activate the initial deal of the cards at the deal stage of the method of play or the dealing of replacement cards at the draw stage of the method of play as is appropriate. Similarly, a DEAL/DRAW location 47 can be provided on the video screen 20 to allow the player to effect either the deal step or the draw step by using conventional touch screen technology.

The button panel 40 is also provided with five "CARD" buttons 48A, 48B, 48C, 48D and 48E associated with each horizontal card location on the video screen display: card button 48A is associated with the left most card location, card button 48B is associated with the second from the left card location, card button 48C is associated with the middle card location, card button 48D is associated with the second from the right card location and card button 48E is associated with the right most card location. Each card button is preferably aligned below the card locations so that the player can easily associate the appropriate card button with the appropriate card location.

The method of play of the various versions of the present invention will now be described. After the player has inserted an appropriate amount of coins, tokens or paper currency to add a sufficient amount of credits on the credit display meter 22, the player makes his initial wager. The player may press the BET button 42 one or more times to bet in single increments or the player may merely press the "BET MAX" button 44 and the maximum number of credits are applied, for example, five credits would be wagered. The player can also use the touch screen locations to make his wager as described above.

The present invention is played using a standard fifty-two card deck. In alternative embodiments of the present invention, one of more Jokers may be added to the conventional deck of playing cards so that poker format games using Jokers may also be employed.

The player makes a wager to participate in the method of play. A first five card hand, HAND ONE 60 shown in FIG. 1, is dealt to the player.

Based on achieving certain starting hand combinations, the player receives one or more extra hands on his next round of play. This process can continue to allow the extra hands to create additional extra hands.

For example, a starting hand of a Three-of-a-Kind or better would entitle the player to an extra hand on the next round of play. When the player engages in the next round of play, the player makes a single wager and each of the additional hands are treated as being played for the same amount of the wager. Thus the player gets to play the extra hand for no additional cost.

For example, if the player bet five credits and the starting hand was a Flush, the player would receive a free extra hand on the next deal. Before the next deal occurs, the player plays out the first deal in accordance with the method of play of conventional video poker by deciding which cards he wishes to hold from the first hand. The player is not required to hold the cards that caused a bonus hand to be awarded for the next round of play, although in most situations it would be to the player's advantage to do so.

After the player has made the selection of which cards the player wishes to hold, if any, replacement cards are displayed for the discarded cards in the first hand. The player is paid for achieving winning poker hand ranking based on a pay table.

The method of play then proceeds on to the next round. The player preferably would have to make a bet on the first hand in the next round to receive the extra hand bonus for no additional cost, although alternatively the player could be allowed to play the next round without having to make an additional bet. If the player then was dealt two or more Three-of-a-Kinds or better on the next round he would receive two extra hands on the following round and would play a total of three hands. The play of the extra hands would be performed according to the method of played described in U.S. Pat. No. 5,823,873. The same cards that are held in the first hand will also be held in the extra hand or hands and the player receives replacement cards in each of the hands and a final poker hand ranking is determined. Winning hand combinations are paid out in accordance with a pay table.

Alternatively, the play of the extra hands would be performed according to the method of play described in U.S. Pat. No. 6,517,074; or U.S. Pat. No. 6,050,568 or U.S. Pat. No. 6,135,883.

For example, as shown in FIG. 1, the player is dealt the Seven of Spades, the King of Spades, the Queen of Spades, the Two of Spades and the Four of Spades. Because starting HAND ONE 60 has the poker hand ranking of Three-of-a-Kind or better (namely a Flush), the player will receive an additional bonus hand on the next round of play at no extra cost.

The player then completes the play of HAND ONE 60 most likely by holding the Flush. Assuming the player had made a five credit wager, the player would win twenty-five credits (see Table 1) for achieving a Flush.

Figure 2:
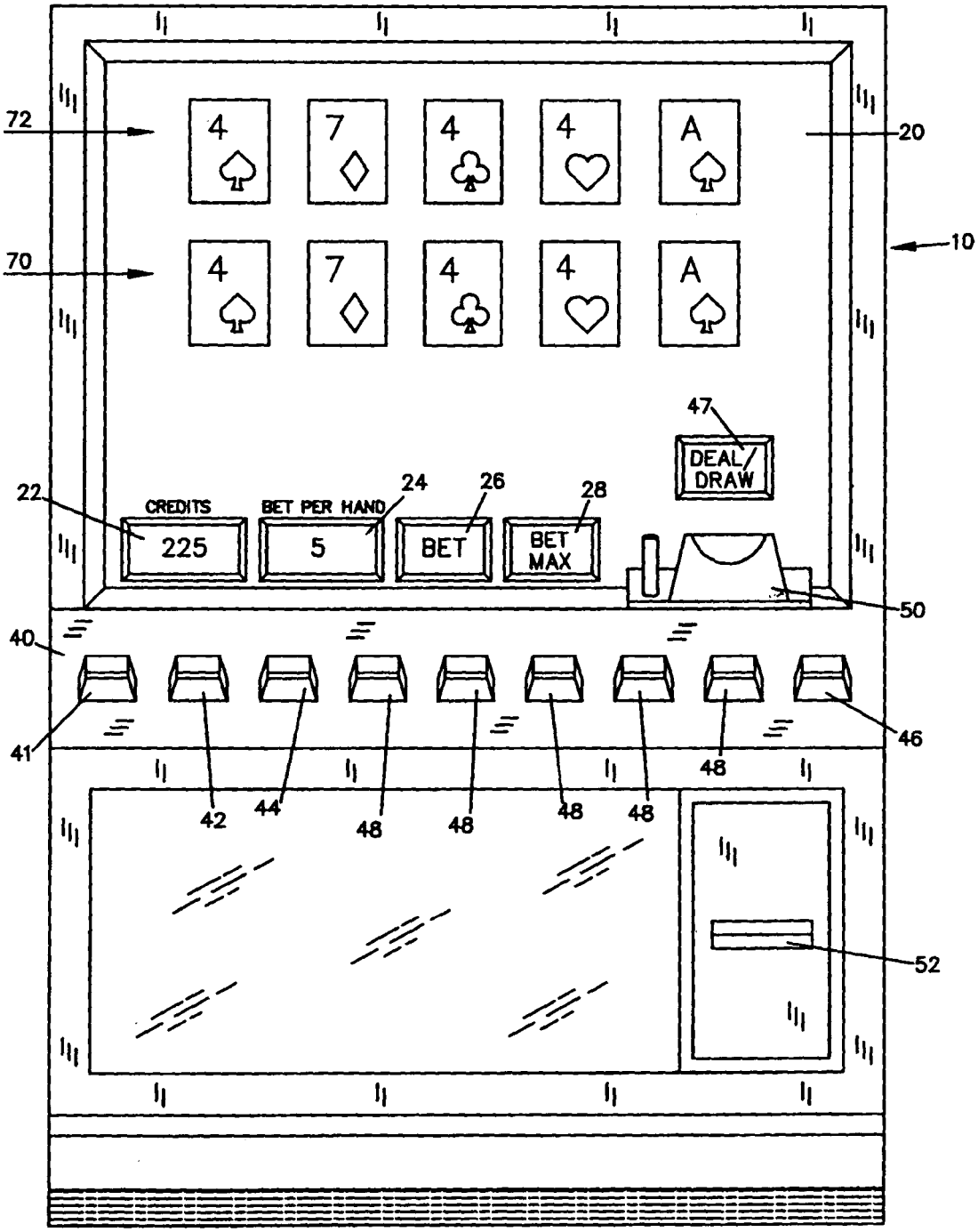
FIG. 2 shows a representative electronic video gaming machine of the present invention including a typical screen display used in the method of play of the present invention after the player has been awarded additional hands on the next round of play.

As shown in FIG. 2, if the player made a single five credit wager on the next round of play, the player would receive two hands, each being played for five credits. The player would be dealt the same hand twice and as shown in FIG. 2, for example, the player could be dealt in HAND ONE 70 the Four of Spades, the Seven of Diamonds, the Four of Clubs, the Four of Hearts and the Ace of Spades. HAND TWO 72 would be dealt with the identical cards by suit and rank.

Because the player has been dealt a Three-of-a-Kind in each of HAND ONE 70 and HAND TWO 72, the player would be awarded two additional bonus hands on the next round of play at no extra cost as long as the player makes a wager to play the first hand of the next round of play.

The player then completes the play of HAND ONE 70 and HAND TWO 72 according to the method of play described in Moody Patent No. 5,823,873. The same cards that are held in one of the hands will also be held in the other hand and the player receives replacement cards in each of the hands and a final poker hand ranking is determined. Winning hand combinations are paid out in accordance with a pay table, such as the pay table shown in Table 1.

This method of play continues from round to round and the player receives additional bonus hands at no extra charge for each starting hand dealt to the player that has a poker hand ranking of Three-of-a-Kind or better. In theory, a player who has a lucky streak could be playing five, ten or even more hands for a single additional wager on each round of play.

Any suitable pay table may be used and would be associated with the poker format being used by the player. For example, the classic poker hand format is Jacks or Better Draw Poker. A suitable pay table for Jacks or Better Draw Poker is shown in Table 1:

TABLE 1

| JACKS OR BETTER DRAW POKER | NUMBER OF COINS WAGERED | | | | |
|---|---|---|---|---|---|
| POKER HAND RANKING | 1 | 2 | 3 | 4 | 5 |
| ROYAL FLUSH | 250 | 500 | 750 | 1000 | 4000 |
| STRAIGHT FLUSH | 50 | 100 | 150 | 200 | 250 |
| FOUR-OF-A-KIND | 25 | 50 | 75 | 100 | 125 |
| FULL HOUSE | 8 | 16 | 24 | 32 | 40 |
| FLUSH | 5 | 10 | 15 | 20 | 25 |
| STRAIGHT | 4 | 8 | 12 | 16 | 20 |
| THREE-OF-A-KIND | 3 | 6 | 9 | 12 | 15 |
| TWO PAIR | 2 | 4 | 6 | 8 | 10 |
| JACKS OR BETTER | 1 | 2 | 3 | 4 | 5 |

If the method of any of the versions of the present invention is used with one of the Joker poker formats, then the standard deck of playing cards would include one or more Jokers as would apparent to one skilled in the art and an appropriate pay table suitable for one of the Joker poker formats would be used.

While the invention has been illustrated with respect to several specific embodiments thereof, these embodiments should be considered as illustrative rather than limiting. Various modifications and additions may be made and will be apparent to those skilled in the art. Accordingly, the invention should not be limited by the foregoing description, but rather should be defined only by the following claims.

What is claimed is:

1. A method of playing a card game comprising:

a) a player makes a first wager to play a draw poker game;

b) displaying an initial draw poker hand to the player;

c) if the initial poker hand comprises a predetermined arrangement of cards, awarding the player an additional round of play of a poker game with at least two hands of cards;

d) the player playing out the initial draw poker hand in accordance with a conventional manner of play of draw poker resulting in a final draw poker hand; and e) determining a poker hand ranking of the final draw poker hand and awarding the player an amount for a winning draw poker hand based on the poker hand ranking according to a draw poker pay table.

2. The method of claim 1 in which the player makes an additional wager to play the next round of play.

3. The method of claim 1 in which the initial draw poker hand has five cards and each hand in the additional round of play has five cards.

4. The method of claim 1 in which the additional round of play is a draw poker game and each hand has identical cards by suit and rank.

5. The method of claim 4 in which, during the additional round of play, the same cards are held in each hand.

6. The method of claim 4 in which, during the additional round of play, different cards may be held in each hand.

7. The method of claim 1 further comprising if the player receives a predetermined arrangement of cards in an initial starting hand of the additional round of play, awarding the player a second additional round of play of a poker game with at least two hands.

* * * * *